United States Patent [19]

Long et al.

[11] 4,069,795

[45] Jan. 24, 1978

[54] START-UP CONTROL FOR FUEL INJECTION SYSTEM

[75] Inventors: E. David Long; Keith C. Richardson, both of Elmira, N.Y.

[73] Assignee: Allied Chemical Corporation, Morris Township, N.J.

[21] Appl. No.: 629,350

[22] Filed: Nov. 6, 1975

[51] Int. Cl.[2] ..... F02B 3/02

[52] U.S. Cl. ..... 123/32 EA; 123/32 EG

[58] Field of Search ..... 123/32 EA, 179 G, 139 ST, 123/179 L, 32 EB, 32 EC, 32 EG

[56] References Cited

U.S. PATENT DOCUMENTS

| | | | |
|---|---|---|---|
| 3,430,616 | 3/1969 | Glocker et al. | 123/32 EA |
| 3,504,657 | 4/1970 | Eichler et al. | 123/32 EA |
| 3,548,791 | 12/1970 | Long | 123/32 EA |
| 3,587,536 | 6/1971 | Inoue | 123/32 EA |
| 3,661,126 | 5/1972 | Baxendale | 123/32 EA |
| 3,734,067 | 5/1973 | Glocker et al. | 123/32 EG |
| 3,750,631 | 8/1973 | Scholl et al. | 123/32 EA |
| 3,812,830 | 5/1974 | Traisnel | 123/32 EG |
| 3,824,967 | 7/1974 | Gordon | 123/32 EA |
| 3,890,944 | 6/1975 | Werner et al. | 123/148 E |
| 3,971,354 | 7/1976 | Luchaco et al. | 123/179 L |

*Primary Examiner*—Charles J. Myhre
*Assistant Examiner*—Parshotam S. Lall
*Attorney, Agent, or Firm*—Ernest D. Buff

[57] ABSTRACT

A fuel injection system for a multi-cylinder engine includes means for generating a sequence of pulses during each cycle of the engine. These pulses trigger variable width pulse generators, sensitive to the engine operating parameters. The variable width pulses are provided to the injectors so that each ejector fires once during an engine cycle and their firing times are spaced over the cycle. During start-up, the pulse widths are diminished and all of the injectors are fired each time the sequencing circuitry provides an output pulse. The total charge provided to each cylinder is thus distributed over the engine cycle, insuring the presence of the proper quantity of fuel for optimum flammability to achieve start-up of the engine in at least one of the cylinders.

11 Claims, 3 Drawing Figures

START-UP CONTROL FOR FUEL INJECTION SYSTEM

BACKGROUND OF THE INVENTION

The invention relates to fuel injection system incorporating means for distributing the fuel charge to each cylinder over the engine cycle during start-up to improve the engine starting characteristics. Examples of a fuel injection system in which the present invention may be used are disclosed in my U.S. patent application, Ser. No. 629,421, entitled "Fuel Injection System" and in my U.S. patent application Ser. No. 629,443, entitled, "A Control Computer for a Fuel Injection System" both filed concurrently herewith on Nov. 6, 1975.

In the past few years interest in fuel injection systems has been spurred because of the decrease in pollutants contained in the auto exhaust emissions of fuel injection equipped cars as compared to cars equipped with conventional carburetors. This improvement results from the greater precision of fuel metering to each cylinder achieved by fuel injection systems.

Recent fuel injection systems have typically fired the injections, singly, in sequence over the engine cycle, or arranged the injector in groups of two or three according to firing order and staggered the firing of the groups over the cycle. The injection time provided by these prior art arrangements may differ appreciably from those injection times which would make it easiest to start the automotive engine. During cold start-up, there is no emission advantage to injecting fuel with reference to a particular crankshaft angle. Further, the quantity of fuel injected during cold start-up is extremely critical if flooding, an overly rich or lean starting mixture with its attendant high levels of exhaust pollutants is to be avoided. The quantity of fuel to be injected to achieve quick start-up will vary principally with ambient temperature, and the condition of the fuel, that is, the specific volatility of the fuel in the tank.

The quantity of fuel injected into a cylinder during starting, based on the measurement of the normal engine operating parameters, may not be a proper amount to create the fuel air mixture in the cylinder for flammability. The exact amount of fuel required to achieve this condition varies in a complicated manner as a function of a number of parameters including the exact air to fuel required ratio in combination with the volatility of the particular volume of fuel being injected. For these reasons considerable difficulty may be encountered in starting the vehicle with a conventional fuel system.

I have found that pollutant level in emissions may be controlled to a noticeable degree by control of the time of the injection pulse relative to the engine cycle. An injected fuel charge may be heated by contact with the intake valve area to partially vaporize the charge and increase the speed of vaporization of the remainder of the charge when it is drawn into the hot cylinder. By injecting the fuel into the intake valve area as soon as possible after the valve closes, this heating action is maximized.

SUMMARY OF THE INVENTION

The present invention is directed toward a fuel injection system having a special start-up control wherein the fuel charge provided to all of the cylinders is effectively distributed over the engine cycle during start-up. More specifically, this distribution is achieved by controlling the the injector means, such as one or more fuel injectors with a series of shorter than normal electrical pulses spaced more frequently over the engine cycle. This mode start-up control substantially increases the starting reliability and speed compared to the prior art techniques of starting the engine with temperature modulated, longer than a normal fuel injection pattern which is used during normal running operation The present invention which provides the fuel charge to each cylinder in a number of smaller portions spaced over the engine cycle has the effect of insuring that during the first turnover of the engine one or more cylinders will receive a fuel charge required for starting purposes. Consider the first cylinder to have its intake valve open after the injection system provides the first small fuel charge to the engine cylinder. This cylinder will receive a fraction of the total fuel charge. The cylinder that receives a charge after the next opening of the injection valve will receive twice that charge and so on during the first engine cycle. The last cylinder to receive a charge will receive the total charge. This technique effectively scans air to fuel ratios provided to the various cylinders during the first engine cycle. As a result, some engine cylinders are more certain to receive a combustible air to fuel ratio for rapid start-up more independent of fuel properties and absolute temperature.

In a preferred embodiment of the invention, which will subsequently be disclosed in detail, the eight injection valves of an eight cylinder engine are arranged in groups of two, and two, and during normal running operation of the engine the four groups are actuated in sequence, once per engine cycle at spaced times over the engine cycle, by pulses derived from a first means, such as a counter that is incremented each time a pulse occurs in the ignition system primary. The trigger pulses from the counter are used to initiate pulses from variable width pulse generators that are controlled by a sixth means, such as sensors which sense the engine operating parameters and control the injector pulse widths as a function of those parameters. During the start-up operation only, each pulse from the counter simultaneously triggers all four variable width pulse generators, to actuate all injectors simultaneously. The lengths of the injection pulses are decreased proportionately so that each cylinder receives some total charge for start-up at the end of the engine cycle.

The variable width pulse generators which are used in the preferred embodiment of the invention employ capacitors which are charged during the receipt of a triggering pulse from the counter to a value dependent upon certain engine operating parameters. Upon termination of the trigger pulse from the counter, the capacitor discharges at a rate which is a function of a fifth means, which as a sensor responses to engine temperature as well as other sensor responses to other engine parameters. An output pulse for one of the groups of injectors is generated during this discharge time. During starting, the voltage to which this capacitor is charged is limited so that the outpuz pulse provided to the injector has approximately one-quarter the width of the pulse that would otherwise be provided to the engine at full throttle.

This start-up control reduces unburned hydrocarbons in the exhaust during start-up which contribute significantly to total vehicle exhaust emission pollutants. This start-up control is highly effective and it is very economical to implement, requiring the addition of only a few low-cost electronic components to the fuel injection system.

Other objectives, advantages and applications of the present invention will be made apparent by the following detailed description of a preferred embodiment of the invention. The description makes reference to the accompanying drawings in which.

Figure 1:
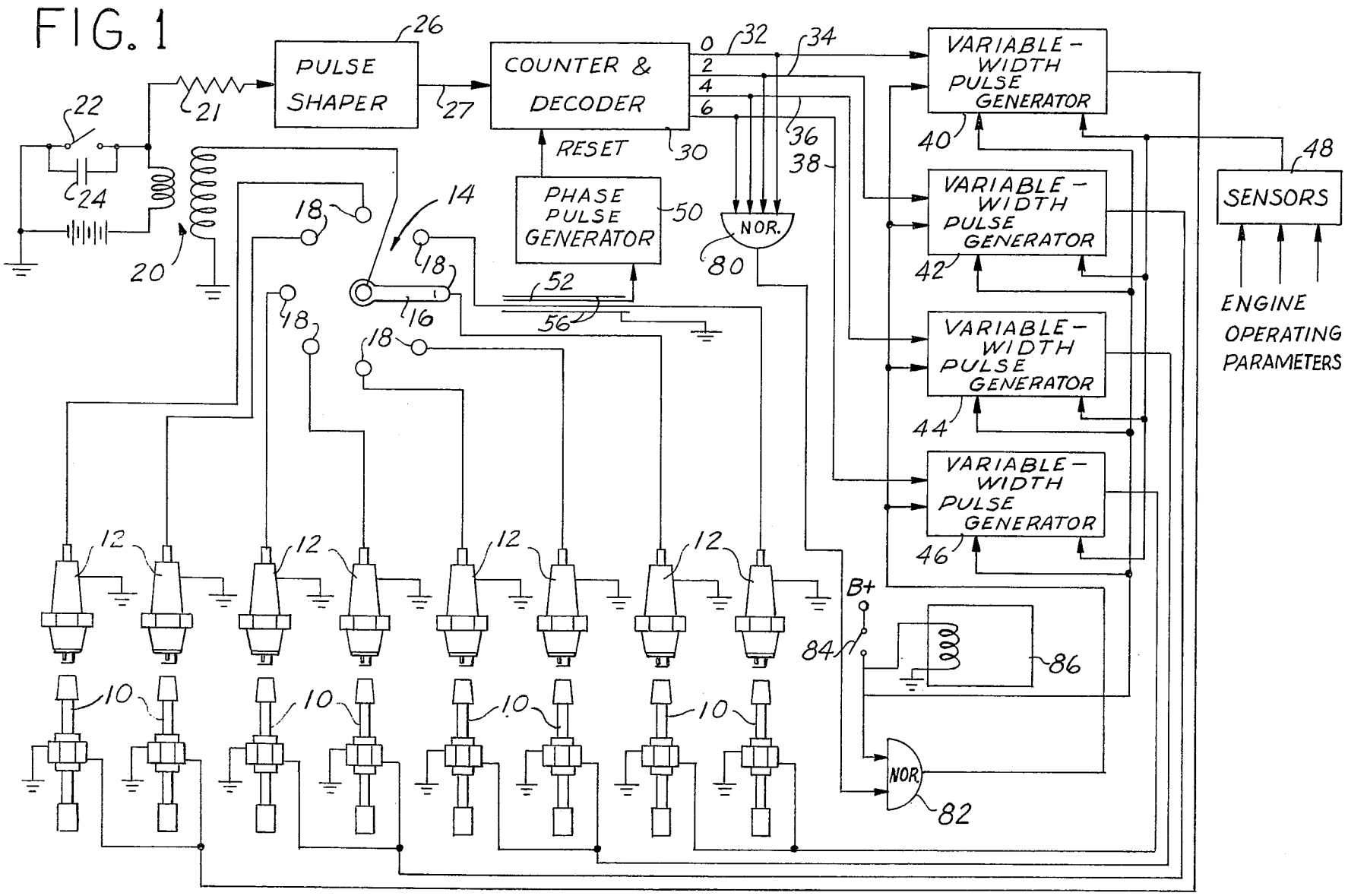
FIG. 1 is a schematic diagram of an ignition and fuel injection system formed in accordance with the preferred embodiment of the invention.

Referring to FIG. 1, an eight cylinder engine employs normally closed, electrically actuated, injection valves 10 associated with each cylinder. These injectors are preferably positioned to inject fuel to the intake valve area exterior of the cylinder so that an injected charge is admitted to the cylinder when the intake valve opens.

Each engine cylinder is also provided with a spark plug 12. Other known forms of igniters could be employed with alternate embodiments of the invention. The firing pulses for the spark plugs 12 are derived from a distributor, generally indicated at 14. The distributor is illustrated as a single-pole eight-throw switch and could be implemented with a conventional mechanical distributor or with electronic circuitry. In either event the contact of the common member 16 to the terminals 18, which are connected to the spark plugs, is performed in synchronism with the rotation of the engine and the common element makes one sweep of the terminals for each engine cycle.

The voltage pulses for generating sparks across the plug gaps are derived from the secondary of a spark coil generally indicated at 20. The opposite end of the secondary is grounded, as are the opposite terminals of the spark plugs 12. Application of current to the primary of the spark coil is achieved by breaker points 22, shunted by a capacitor 24. The breaker points also operate in timed relation to the rotation of the engine. In alternative embodiments of the engine the breaker points 22 and spark coil 20 could be replaced by suitable electronic apparatus.

To actuate the injectors 10 in timed relation to the operation of the engine and the firing of the spark plugs, a fourth means such as pulse shaper 26 is connected to the spark coil primary circuit by a voltage limiting resistor 21. Each time the breaker points open, i.e., eight times during each engine cycle, a voltage spike is applied to the pulse shaper 26.

The pulse shaper 26 differentiates, integrates, and clips the signal received each time the points open to serially provide a generally rectangular pulse. These pulses are provided all one line 27 to a first means such as a counter and decoder 30 eight times per cycle. The counter and decoder includes a three-stage binary counter and associated circuitry for decoding the state of the counter to provide outputs on one of four lines, 32, 34, 36 and 38. Assuming the counter to be initially zero, an output is provided on line 32. An output is provided on line 34 after two pulses have been received from the pulse shaper 26; an output on line 36 is provided when the fourth pulse is received; and an output on line 38 when the sixth pulse is received after the eighth pulse, the counter returns to zero and again causes an output on line 32. Thus, four outputs are provided sequentially from the counter on lines 32, 34, 36 and 38 one line at a time in sequence during each engine cycle wherein the breaker points 22 open eight times serially.

The output pulses on lines 32, 34, 36 and 38 are provided sequentially to four variable width pulse generators, 40, 42, 44 and 46 respectively. These pulse generators each have inputs from a sixth means which is a group of sensors 48 which sense various engine operating conditions such as manifold pressure, engine temperature, speed throttle position and barometric pressure. The sixth means may be considered to include a fifth means which is a temperature sensor responsior to engine temperature. Upon receipt of a pulse on one of the input lines 32, 34, 36 or 38, the associated variable width pulse generator provides an output pulse having a pulse length which is determined by the outputs of the sensors 48.

The variable width pulse generator 40 is connected to one pair of injectors 10, and the pulse generators 42, 44 and 46 are each connected to another pair of injectors. An output pulse from one of the pulse generators actuates its two associated injector valves. Assuming constant pressure in the fuel line to the injectors, the quantity of fuel injected is proportional to this pulse width. During a single engine cycle, the four groups of two injectors each provide fuel to their associated engine intake valves at timed intervals.

The counter 30 inherently returns to zero state after eight counts. However, to insure that the counter operates in the correct phase relationship to the rotation of the distributor 14, and to prevent the counter from getting out of synchronism by virtue of some extraneous malfunction, a phase pulse generator 50 is connected to the counter to provide a reset pulse. The phase pulse generator 50 receives an input from a pulse detector pick-up 52 connected to the lead to one of the spark plugs 12. Pick-up 52 consists of a conductive wire 54 supported in fixed parallel relation to a section of one of the spark plug leads. The section is enclosed in a metallic sheath 56 which is grounded. Each spark plug is fired by the distributor 14 once during each engine cycle, and accordingly the phase pulse generator 50 provides a pulse to a reset function counter 30 once each engine cycle. This insures a proper phase relationship between the outputs of the counter 30 and the firing of the spark plugs.

The four outputs of the counter and decoder 30 are also provided to the four inputs of a combinor, which may be a first NOR gate 80. The output of this gate, which is normally high and goes low when any pulse is received at one of its outputs, is provided to a second NOR gate 82. The NOR gates 80 and 82 may be considered a third means. The other input to the NOR gate 82 is from a second means which may be the engine starter switch 84, which also provides power to the engine starter solenoid 86. The voltage relationship is such that the output of the NOR gate 82 goes high when the starter switch 84 is closed and the other input to NOR gate 82 goes low, indicating a high ouput on any of the four outputs of the counter 30. The output of the NOR gate 82 is provided to all four of the variable width pulse generators 40, 42, 44 and 46 and accordingly triggers an injector actuating pulse from each of them. These pulses thus occur simultaneously and serially four times each engine cycle during start-up. The starter switch 84 is also connected to each of the variable width pulse generators 40, 42, 44 and 46 and acts to decrease the width of the pulse generated by them with respect to the pulse that would be generated, based on the output of the sensors 48, during normal operation. Accordingly, during start-up whenever the starter switch is closed, each of the injectors 10 is actuated four times during each engine cycle and each actuation pulse time is shortened relative to the actuation pulse time during normal engine operation.

Figure 2:
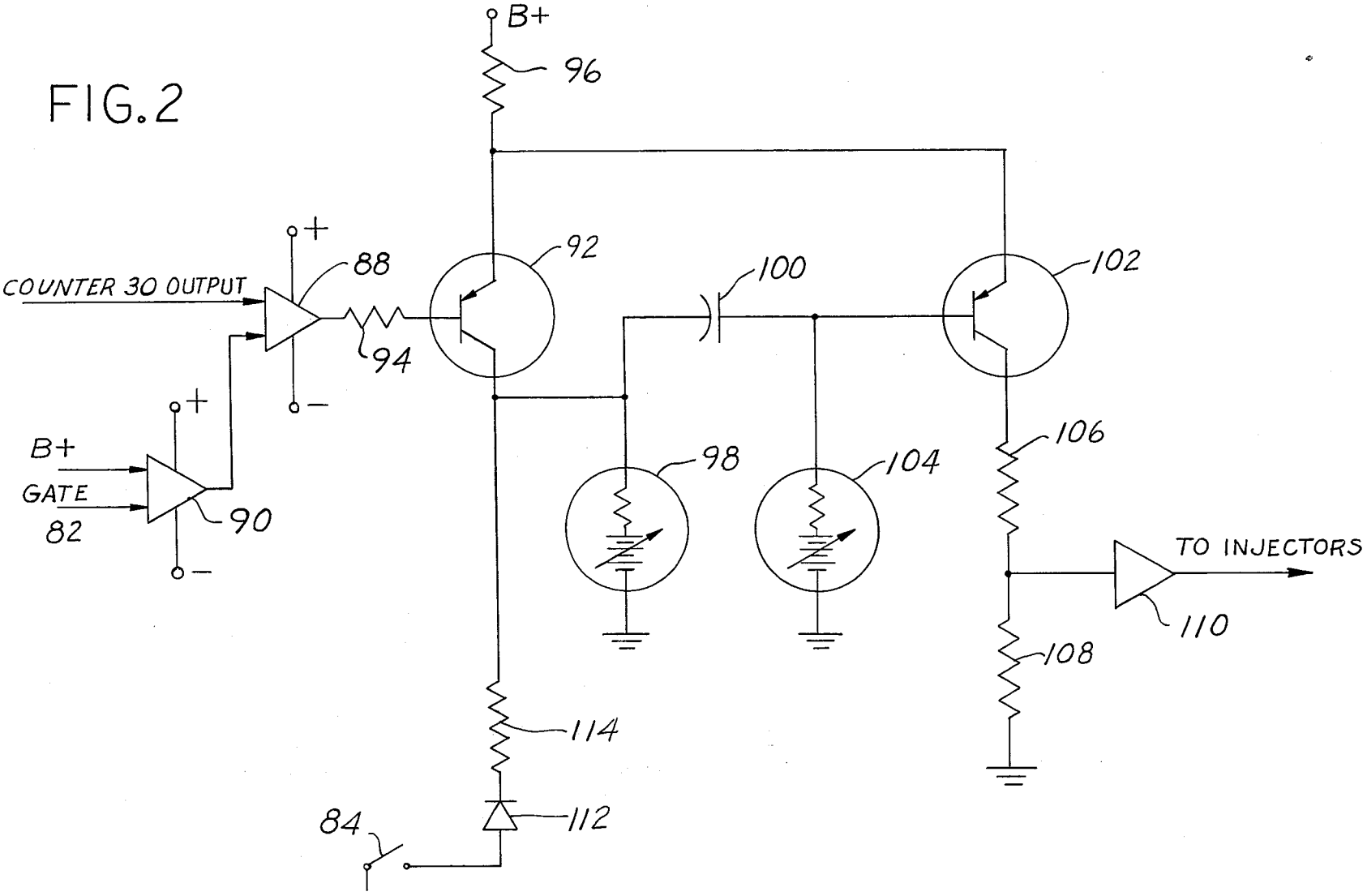
FIG. 2 is a more detailed schematic diagram of a variable width pulse generator of the type used with the preferred embodiment of the invention.

FIG. 2 illustrates a detailed construction of each of the four variable width pulse generators 40, 42, 44 and 46. The output of the counter 30 is applied to one input of differential amplifier 88 connected as a switch. The other input to the amplifier 88 is derived from the output of a second differential amplifier 90, also connected as a switch. One of the inputs of the amplifier 90 is connected to the positive terminal of a power supply and the other input is connected to the output of the NOR gate 82.

During normal operation of the engine, the output of the NOR gate 82 is low and the differential amplifier 90 provides a first level reference voltage to the differential amplifier 88. This reference voltage is at such a level that when the particular output of the counter 30 which is connected to amplifier 88 goes high, the output of amplifier 88 goes low and decreases the voltage applied to the base of a transistor 92, through resistance 94. When the output of NOR gate 82 goes low, the output of the differential amplifier 90 goes low and also causes a low output from the differential amplifier 88. Thus, a lowered voltage is applied to the base of the transistor 92 upon either the occurrence of a high output from the corresponding input of the counter 30 or a high output from gate 82 which occurs during starting, whenever any of the outputs of the counter 30 are high.

The emitter of transistor 92 is connected to the positive voltage supply through a resistance 96. Its collector is connected to ground through an eighth means which may be circuitry 98 which acts like a variable voltage source, and is schematically designated as such. The circuitry 98 is controlled by various engine operating parameters and in the preferred embodiment of the invention, it is primarily a function of the manifold pressure. In alternative embodiments, other combinations of parameters could be used to determine the voltage of circuitry 98.

The collector of transistor 92 is also connected to one terminal of a capacitor 100 which has its other terminal connected to the base of a second transistor 102 and also to ground through the fifth means, which may be an engine temperature sensitive device 104 which provides a variable voltage. In the preferred embodiment of the invention, the engine temperature sensitive device is primarily sensitive to engine temperature, and may constitute a thermistor. Other parameters may be selected for controlling the voltage of circuitry 104 in other embodiments of the invention. The emitter of transistor 102 is connected to the positive terminal of the power supply through resistance 96 and its collector is connected to ground through a pair of resistances 106 and 108.

In the absence of a negative going output from the differential amplifier 88, the transistor 92 operates in a saturated conduction region. Transistor 102 is also conductive and the voltage at each end of the capacitor 100 is maintained equal to the emitter voltage of transistor 102. When the differential amplifier 88 provides a negative going pulse to the base of transistor 92, transistor 92 is switched out of conduction, allowing the capacitor 100 to charge to a voltage that is dependent upon the effective value of the manifold pressure sensor 98 and the emitter voltage of transistor 102.

When the negative going pulse to the base of transistor 92 terminates, transistor 92 immediately becomes conductive again and the voltage at the base of transistor 102 goes sharply positive in an amount proportional to the charge placed on the capacitor 100, turning off transistor 102. Capacitor 100 begins to discharge through the effective resistance 104 at a rate which is a complex function of engine temperature and manifold pressure. This discharge continues until the voltage across circuitry 104 reaches the emitter voltage of transistor 102, causing transistor 102 to turn on, and to clamp the voltage on capacitor 100.

The time during which transistor 102 is turned off is therefore dependent upon the manifold pressure, which controls the voltage to which the capacitor 100 charges during the off time of transistor 92, and is also dependent upon the engine temperature, which controls the rate at which the capacitor 100 discharges after transistor 92 again becomes conductive. An amplifier 110 is connected between the resistances 106 and 108 in the collector circuit of transistor 102 and provides a sharp, negative going pulse, having a width controlled by these engine parameters, to the injectors associated with that variable width pulse generator.

When the starter switch 84 is closed, the collector of transistor 92 is also connected to the positive supply voltage through a ninth means which may be a diode 112 and a resistor 114. This establishes a voltage level at the collector of transistor 92 which modifies the voltage to which the capacitor 100 charges during the off time of transistor 92. Since manifold pressure is essentially atmospheric during starting, this voltage allows the capacitor 100 to charge to a voltage which is less than the voltage to which it would normally charge if the switch 84 were open. This decreases the width of the pulse provided to the injectors so that a total fuel charge is distributed over the four pulses that an injector receives in each engine cycle during starting.

Figure 3:
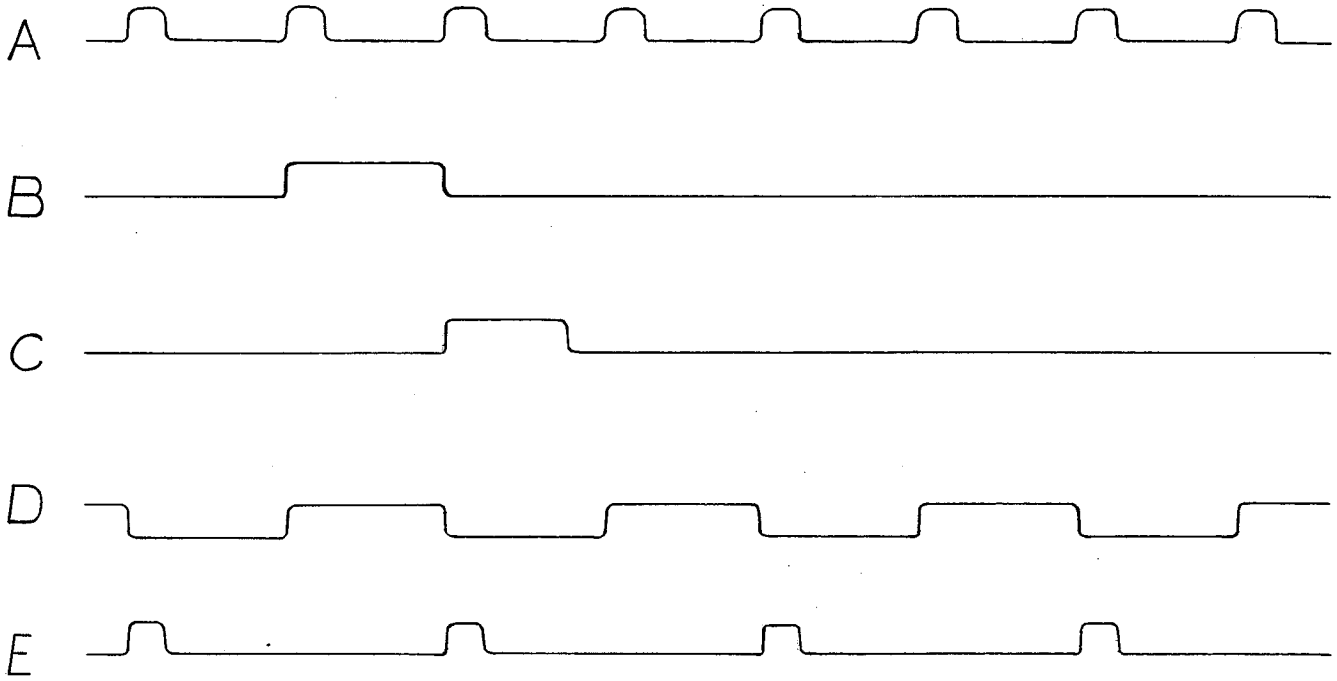
FIG. 3 is a plot of voltages appearing at various points in the circuitry during operation of the engine.

FIG. 3 illustrates the waveforms occurring at various points in the circuit of FIG. 1 during a full cycle of engine operation. Line 3A is a plot of the serial outputs on line 27 from the pulse shaper 26 during one full engine cycle. The breaker points 22 open eight times during the engine cycle, providing eight outpuzs from the pulse shaper. Line 3B plots one of the sequential outputs on one of the decoded counter lines 32, 34, 36 and 38 during that engine cycle. The particular output goes high upon the receipt of the leading edge of one of the pulses from the pulse shaper 26 and returns to its low state upon receipt of the leading edge of the next pulse. It is high only once during the cycle. Line 3C illustrates one of the sequential outputs of from the variable width pulse generator controlled by the output of line 3B, during normal engine operation. Upon receipt of the trailing edge of the pulse on line 3B, the variable width pulse generator controlled by that line goes high and remains high for a period of time determined by the conditions of the outputs of sensors 48.

Line 3D plots the serial inputs received by all of the variable width pulse generators during start-up of the engine. Effectively, the inputs of all of the four lines 32, 34, 36 and 38 are provided to each of the variable width pulse generators and accordingly each one receives four serially spaced pulses of the type illustrated on line 3B, during a full engine cycle during start-up. Line 3E plots serial pulse outputs generated by each of the varaible width pulse generators during starting operation in response to the input plotted on line 3D. Upon occurrence of the trailing edge of each of the pulses illustrated in line 3D, the output of each of the variable width pulse generators goes high and remains high for a period that is a fraction of the period of the pulse generated during normal operation of the engine, as illustrated in line 3C. Typically, the total width of the four output pulses during start-up operation will approximately equal the width of a single output pulse during normal operation with the other engine parameters being equal.

The embodiments of the invention in which an exclusive property or privilege is claimed are defined as follows:

1. In a fuel injection system for an internal combustion engine including injector means associated with each of the engine cylinders and a first means for operatively providing actuating pulses to the injector means to cause said injector means to actuate once during each engine cycle during normal operation of the engine; the improvement of a start-up control comprising a second means for providing an electrical start-up signal during start-up operation of the engine, said start-up signal modifying said actuating pulses to said injector means to shorten the pulse width of said actuating pulses during start-up operation relative to the width of the actuating pulses provided during normal operation of the engine; a third means comprising an electronic gate conditioned by said start-up signal during start-up operation of the engine for causing each of the injector means to actuate a plurality of times during each engine cycle during said start-up operation; and including an electronic combinor connected to said first means for receiving first trigger pulses sequentially from said first means and providing second trigger pulses serially to said electronic gate; and a fifth means for modulating said shortened actuating pulses provided during start-up operation as a function of engine temperature during start-up operation, whereby said shortened temperature-dependent actuating pulses during start-up operation effectively scan a range of air to fuel ratios provided to the engine.

2. The start-up control of claim 1 wherein said third means, for causing the injector means to actuate a plurality of times during each engine cycle during start-up operation, causes all of said injector means to actuate simultaneously.

3. The start-up control of claim 1 wherein: said first means for causing the injector means to actuate once during each engine cycle during normal operation of the engine generates first trigger pulses sequentially during each engine cycle.

4. The start-up control of claim 3 wherein said first means for providing first triggering pulses sequentially during each engine cycle comprises: a counter and a fourth means for incrementing the counter at a plurality of regular intervals during normal and start-up operation of the engine.

5. In a fuel injection system for an internal combustion engine having a plurality of cylinders, a plurality of injector means, one injector means associated with each cylinder, and a fourth means connected to the engine for generating a plurality of trigger pulses in spaced relationship to one another during each engine cycle; the improvement of a start-up control comprising a second means for generating an electrical signal during start-up operation of the engine, said start-up signal modifying said actuating pulses to said injector means to shorten the pulse width of said actuating pulses during start-up operation relative to the width of the actuating pulses provided during normal operation of the engine; a third means for operatively receiving said trigger pulses, said third means operative to provide a single actuating pulse to each injector means during each engine cycle during normal operation of the engine and a plurality of actuating pulses to each injector means during each engine cycle during start-up operation of the engine; a fifth means for modulating said shortened actuating pulses provided during start-up operation as a function of engine temperature during start-up operation, whereby said shortened temperature-dependent actuating pulses during start-up operation effectively scan a range of air to fuel ratios provided to the engine; and a sixth means for controlling the width of the injector actuating pulses as a function of engine parameters, said sixth means comprising a capacitor, a charging circuit for the capacitor, a discharging circuit for the capacitor, a first transistor and a second transistor, circuitry connecting the first transistor to the second transistor and connecting the capacitor to the second transistor to maintain the second transistor in a conductive mode unless the first transistor is in a conductive mode and the capacitor is charged, and circuitry for charging the capacitor when the first transistor is in a nonconductive mode.

6. The start-up control of claim 5 and further comprising: circuitry for normally maintaining the first transistor in a conductive mode and switching said first transistor into a non-conductive mode at intervals occurring in timed relation to the operation of the engine.

7. The start-up control of claim 5 wherein said second means shortens said actuating pulses by controlling the charging of the capacitor when the engine is in start-up operation.

8. The start-up control of claim 5 wherein said fifth means and said sixth means in combination control the rate of discharge of the capacitor when the engine is in start-up operation.

9. In a fuel injection system for an internal combustion engine including injector means associated with each of the engine cylinders, a variable width pulse generator for generating injector actuating pulses as a function of engine operating parameters, said injector actuating pulses actuating said injector means once during each engine cycle during normal operation of the engine and a plurality of times during each engine cycle during start-up operation of the engine, the improvement wherein the system has a start-up control comprising a second means operative to shorten the injector actuating pulses during start-up of the engine relative to the injector actuating pulses during normal operation of the engine; a fifth means for modulating said shortened actuating pulses provided during start-up operation as a function of engine temperature during start-up operation, whereby said shortened temperature-dependent actuating pulses during start-up operation effectively scan a range of air to fuel ratios provided to the engine; the variable width pulse generator comprises a capacitor and an eighth means for charging said capacitor from a voltage source at regular intervals during operation of the engine, and said second means for shortening the injector actuating pulses during start-up operation of the engine includes a ninth means for modifying the voltage from said voltage source to said capacitor.

10. The start-up control of claim 9 wherein said second means is a start-up switch and said ninth means for modifying the voltage is responsive to closure of said start-up switch.

11. In a fuel injection system for an internal combustion engine including injector means associated with each of the engine cylinders and a first means for operatively providing actuating pulses to the injector means to cause said injector means to actuate once during each engine cycle during normal operation of the engine; the improvement wherein the system comprises a start-up control comprising a second means for providing an electrical start-up signal during start-up operation of the engine, said start-up signal modifying said actuating pulses to said injector means to shorten the pulse width of said actuating pulses during start-up operation relative to the width of the actuating pulses provided during normal operation of the engine; a third means conditioned by said start-up signal for causing each of the injector means to actuate a plurality of times during each engine cycle during start-up operation of the engine; and said first means generates first trigger pulses sequentially during each engine cycle and comprises a counter and a fourth means for incrementing the encounter at a plurality of regular intervals during normal and start-up operation of the engine.

* * * * *